US010203623B2

(12) United States Patent
Uchino et al.

(10) Patent No.: US 10,203,623 B2
(45) Date of Patent: Feb. 12, 2019

(54) TONER FOR DEVELOPING ELECTROSTATIC IMAGE

(71) Applicant: Konica Minolta, Inc., Tokyo (JP)

(72) Inventors: Yasuko Uchino, Hino (JP); Hitomi Motani, Hino (JP); Tomomi Oshiba, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/799,222

(22) Filed: Oct. 31, 2017

(65) Prior Publication Data

US 2018/0129147 A1 May 10, 2018

(30) Foreign Application Priority Data

Nov. 9, 2016 (JP) ..... 2016-219252

(51) Int. Cl.

| | |
|---|---|
| ***G03G 9/09*** | (2006.01) |
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0926* (2013.01); *G03G 9/0819* (2013.01); *G03G 9/08711* (2013.01); *G03G 9/08755* (2013.01); *G03G 9/08795* (2013.01); *G03G 9/08797* (2013.01); *G03G 9/0902* (2013.01); *G03G 9/09708* (2013.01); *G03G 9/09716* (2013.01); *G03G 9/09725* (2013.01)

(58) Field of Classification Search

CPC ..... G03G 9/0902; G03G 9/0926; G03G 9/09

See application file for complete search history.

(56) References Cited

U.S. PATENT DOCUMENTS

| | | | | |
|---|---|---|---|---|
| 7,356,281 | B2 * | 4/2008 | Miyakawa | G03G 9/08 399/111 |
| 8,617,780 | B2 * | 12/2013 | Gong | G03G 9/0812 430/108.3 |
| 2013/0330522 | A1 * | 12/2013 | Suzuki | G03G 9/0902 428/195.1 |
| 2015/0268576 | A1 * | 9/2015 | Saito | G03G 9/093 430/105 |

FOREIGN PATENT DOCUMENTS

| | | | | |
|---|---|---|---|---|
| JP | 2005043443 | * | 2/2005 | G03G 9/08 |
| JP | 2006317601 | A | 11/2006 | |

OTHER PUBLICATIONS

Machine English language translation of JP 2005043443, dated Feb. 2005.*

* cited by examiner

*Primary Examiner* — Hoa V Le

(74) *Attorney, Agent, or Firm* — Lucas & Mercanti, LLP

(57) ABSTRACT

It is an object to suppress yellowing of a binder resin while obtaining an image with a high degree of whiteness and to suppress occurrence of image defects when printing at a high temperature and a high humidity.

A toner for developing an electrostatic image, the toner including: white toner base particles containing a binder resin and titanium oxide having an average particle size of from 130 to 600 nm; and an external additive including strontium titanate.

12 Claims, 1 Drawing Sheet

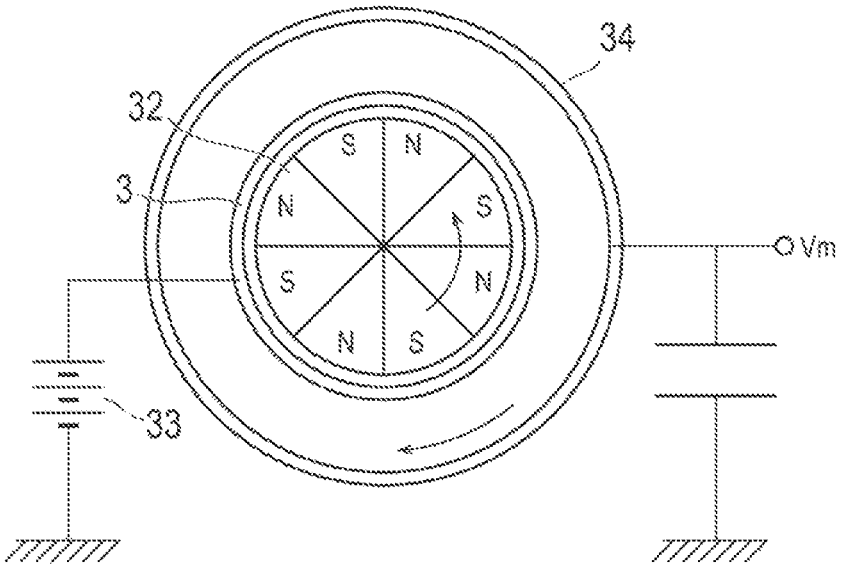
34
32
3
S
N
N
S
S
N
N
S
Vm
33

TONER FOR DEVELOPING ELECTROSTATIC IMAGE

CROSS-REFERENCE TO RELATED APPLICATION

Japanese Patent Application No. 2016-219252 filed on Nov. 9, 2016, including description, claims, drawings, and abstract the entire disclosure is incorporated herein by reference in its entirety.

BACKGROUND

Technological Field

The present invention relates to a toner for developing an electrostatic image.

Description of the Related Art

In the image forming method using an electrophotographic method, image exposure is performed after the image forming body is uniformly charged by a charging means to form an electrostatic image. The latent image portion is developed by a subsequent developing means to form a toner image.

In recent years, in the field of toner for developing an electrostatic image to be used in the electrophotographic image formation, development to cope with various demands from the market has been conducted. In particular, the kinds of recording media onto which printing is performed have increased, and the demand on the correspondency of the printing machine to printing media from the market is significantly high. For example, in the case of outputting a matter on a special recording medium such as colored paper, black paper, aluminum evaporated paper, or a transparent film, it is impossible to obtain sufficient color development with only a full color toner of yellow, magenta, cyan, and black toners by the influence of the color characteristics of the recording medium. Hence, in order to improve the added value of image, the development of white toner to be formed in the lower layer or upper layer of the image formed by a combination of the above-described color toners is under way.

In particular, in the case of using a transparent film as a medium (recording medium), the visibility of color toner is improved and the added value as an image can be enhanced by forming the image on a white toner image with a color toner. In addition, it is possible to express the "white color" to be difficultly expressed with color toners by forming a white toner image on colored paper. For this purpose, it is important to enhance the hiding power of the white toner and to further improve the degree of whiteness, and various technologies have been developed.

As described above, it is significantly important to prevent a change in the degree of whiteness for the image on which the "white color" with enhanced added value is expressed. For example, JP 2006-317601 A discloses a technology for preventing discoloration of white toner by using titanium oxide as a white pigment and containing an antioxidant at the outer circumferential portion of the white toner.

SUMMARY

The environment in which an image is used as a white image with enhanced added value has been diversified, the image is often posted outdoors particularly in the case of being used in posters and the like, and the toner is affected by ultraviolet rays. In particular, when titanium oxide is used as a white pigment, it can be expected that an image with a high degree of whiteness can be obtained by the high hiding power but titanium oxide absorbs ultraviolet rays to generate radicals, to deteriorate the resin of the toner, and thus to cause a problem of yellowing of the resin since titanium oxide itself exhibits high photocatalytic activity.

In the technology of JP 2006-317601 A, an antioxidant is contained at the outer circumferential portion of the white toner to prevent discoloration of the white toner, but it has been found that there is a problem that the high molecular binder resin itself is plasticized and the deterioration of toner layer is accelerated when a low molecular organic material is added to the binder resin. In other words, it has been found that when a low molecular organic material exists in the interior (surface layer portion) of the toner base particles, plasticization of the resin is likely to occur and there is a possibility that aggregation, a decrease in fluidity, and a decrease in charging property due to thermal unstability proceed. Hence, the present inventors have considered that it is required to prevent yellowing by another method.

In addition, it has also been found that titanium oxide has low resistance and the image defect due to a decrease in charging property particularly at a high temperature and a high humidity (HH environment) is a problem.

Accordingly, the present invention has been made in view of the above circumstances, and an object thereof is to suppress yellowing of a binder resin while obtaining an image with a high degree of whiteness and to suppress occurrence of image defects when printing at a high temperature and a high humidity.

The present inventors have conducted extensive researches in order to achieve the object. As a result, it has been found out that it is possible to significantly suppress yellowing while obtaining an image with a high degree of whiteness and to significantly suppress occurrence of image defects when printing at a high temperature and a high humidity by combining toner base particles containing titanium oxide having a specific particle size and an external additive including strontium titanate.

In other words, to achieve at least one of the abovementioned objects, according to an aspect of the present invention, a toner for developing an electrostatic image reflecting one aspect of the present invention comprises, white toner base particles containing a binder resin and titanium oxide having an average particle size of from 130 to 600 nm; and an external additive including strontium titanate.

BRIEF DESCRIPTION OF THE DRAWINGS

The advantages and features provided by one or more embodiments of the invention will become more fully understood from the detailed description given hereinbelow and appended drawings which are given by way of illustration only, and thus are not intended as a definition of the limits of the present invention.

FIG. 1 is a schematic configuration diagram of an apparatus for measuring the adhesive strength.

DETAILED DESCRIPTION OF EMBODIMENTS

Hereinafter, one or more embodiments of the present invention will be described with reference to the drawings. However, the scope of the invention is not limited to the disclosed embodiments.

The toner of the present invention is a toner for developing an electrostatic image, which contains white toner base particles containing a binder resin and titanium oxide having an average particle size of from 130 to 600 nm and an external additive including strontium titanate. It is possible to suppress yellowing of the binder resin while obtaining an image with a high degree of whiteness and to suppress occurrence of image defects when printing at a high temperature and a high humidity by such a configuration.

Hereinafter, embodiments of the present invention will be described. It should be noted that the present invention is not limited to only the following embodiments. In addition, the operations and the measurements of physical properties are conducted at room temperature (20 to 25° C.)/relative humidity of from 40 to 50% RH unless otherwise stated.

<Binder Resin>

The white toner base particles of the present invention contain a binder resin. The binder resin is not particularly limited as long as it is a resin that can be used in a toner for developing an electrostatic image, and a conventionally known resin can be used, but it preferably includes at least either of a polyester resin or a vinyl resin.

The polyester resin and the vinyl resin may exhibit crystallinity or amorphousness. Here, a "resin exhibiting crystallinity" refers to a resin having a clear melting peak in a DSC curve measured by using a differential scanning calorimeter "Diamond DSC" (manufactured by PerkinElmer Inc.). In addition, a "resin exhibiting amorphousness" refers to a resin which does not have a melting point but has a relatively high glass transition temperature (Tg) when subjected to differential scanning calorimetry (DSC). This glass transition temperature is preferably from 40 to 70° C. and more preferably from 40 to 60° C.

(Polyester Resin)

According to a preferred embodiment of the present invention, the binder resin includes a polyester resin. In a case in which the binder resin includes a polyester resin, the carbonyl group derived from the ester of polyester is easily oxidized by ultraviolet rays and thus yellowing of the binder resin is easily caused. In order to cope with this, the toner of the present invention contains an external additive including strontium titanate. It is presumed that this makes it possible to effectively suppress yellowing of the toner containing a polyester resin to be originally easily oxidized by ultraviolet rays as a binder resin and to further exert the effect of the present invention. In addition, it is possible to improve the degree of initial whiteness by the refractive index of the crystalline resin itself by using a crystalline resin as the binder resin. In that sense, it is preferable to further include a crystalline polyester resin as a binder resin. Accordingly, in a preferred embodiment of the present invention, the binder resin includes a polyester resin, the polyester resin includes an amorphous polyester resin, and the binder resin further includes a crystalline polyester resin. In addition, in a preferred embodiment of the present invention, the binder resin includes a vinyl resin and the binder resin further includes a crystalline polyester resin.

(Crystalline Polyester Resin)

A crystalline polyester resin refers to those exhibiting crystallinity among known polyester resins obtained by the polycondensation reaction of a di- or higher carboxylic acid (polycarboxylic acid) and any derivative thereof with a dihydric or higher alcohol (polyhydric alcohol) and any derivative thereof. Examples of derivatives of polycarboxylic acids may include alkyl esters, acid anhydrides, and acid chlorides of polycarboxylic acids, and examples of derivatives of polyhydric alcohols may include ester compounds of polyhydric alcohols and hydroxycarboxylic acids.

A polycarboxylic acid is a compound containing two or more carboxyl groups in one molecule. Among these, a dicarboxylic acid is a compound containing two carboxyl groups in one molecule, and examples thereof may include saturated aliphatic dicarboxylic acids such as oxalic acid, malonic acid, succinic acid, adipic acid, pimelic acid, 1,6-hexanedicarboxylic acid (octanedioic acid), sebacic acid, azelaic acid, n-dodecylsuccinic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, and 1,14-tetradecanedicarboxylic acid; alicyclic dicarboxylic acids such as cyclohexanedicarboxylic acid; unsaturated aliphatic dicarboxylic acids such as maleic acid, fumaric acid, citraconic acid, and itaconic acid; and aromatic dicarboxylic acids such as phthalic acid, isophthalic acid, and terephthalic acid. In addition, examples of polycarboxylic acids other than the dicarboxylic acid may include tri- or higher polycarboxylic acids such as trimellitic acid and pyromellitic acid. In addition, examples of derivatives of polycarboxylic acids may include anhydrides or alkyl esters having from 1 to 3 carbon atoms of these carboxylic acid compounds. These may be used singly or in combination of two or more kinds thereof.

A polyhydric alcohol is a compound containing two or more hydroxyl groups in one molecule. Among these, a dihydric polyol (diol) is a compound containing two hydroxyl groups in one molecule, and examples thereof may include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1, 10-decanediol, 1,12-dodecanediol, neopentyl glycol, and 1,4-butenediol. In addition, examples of polyols other than the dihydric polyol may include trihydric or higher polyhydric alcohols such as glycerin, pentaerythritol, trimethylolpropane, and sorbitol. These may be used singly or in combination of two or more kinds thereof.

The method of forming the crystalline polyester resin is not particularly limited, and for example, the crystalline polyester resin can be formed by polycondensation (esterification) of the polycarboxylic acid with the polyhydric alcohol by utilizing a known catalyst for esterification such as dibutyltin oxide.

In addition, the molecular weight of the crystalline polyester resin is preferably from 3,000 to 70,000 and more preferably from 5,000 to 50,000 in terms of weight average molecular weight (Mw). In addition, the temperature of the peak top by DSC is preferably from 60 to 80° C. Furthermore, it is preferable that the crystalline polyester resin is contained in the binder resin in the toner base particles at from 3 to 30% by mass.

(Amorphous Polyester Resin)

According to a preferred embodiment of the present invention, the polyester resin includes an amorphous polyester resin. According to such an embodiment, an effect of exerting a low temperature fixing property and a heat resistant storage property at a higher level is obtained.

The amorphous polyester resin usually refers to a resin which is obtained by the polycondensation reaction of a di- or higher carboxylic acid (polycarboxylic acid) with a dihydric or higher alcohol (polyhydric alcohol) and exhibits amorphousness.

Specific examples of the aromatic carboxylic acid that can be used in the amorphous polyester resin are not particularly limited, and aromatic dicarboxylic acids having from 6 to 12 carbon atoms are preferable, and examples thereof may include phthalic acid, terephthalic acid, isophthalic acid, t-butylisophthalic acid, orthophthalic acid, tetrachlorophthalic acid, chlorophthalic acid, nitrophthalic acid, p-phenylene diacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, 4,4'-biphenyldicarboxylic acid, trimellitic acid, pyromellitic acid, naphthalenetricarboxylic acid, naphthalenetetracarboxylic acid, pyrenetricarboxylic acid, and pyrenetetracarboxylic acid.

Specific examples of other carboxylic acids that can be used together with the aromatic carboxylic acids are not particularly limited, and other carboxylic acids may be appropriately selected from among the polycarboxylic acids listed above.

Examples of the aromatic polyhydric alcohol which can be used in the amorphous polyester resin may include dihydric alcohols such as bisphenol A ethylene oxide adduct and bisphenol A propylene oxide adduct; and trihydric or higher polyols such as glycerin, pentaerythritol, hexamethylol melamine, hexaethylol melamine, tetramethylol benzoguanamine, tetraethylol benzoguanamine. These may be used singly or in combination of two or more kinds thereof.

Other polyhydric alcohols that can be used together with the aromatic polyhydric alcohols may be appropriately selected from among the polyhydric alcohols listed above.

The method of producing the amorphous polyester resin is not particularly limited, and, for example, the description on the method of producing the crystalline polyester resin can be adopted in the same manner.

Incidentally, the glass transition temperature (Tg) of the amorphous polyester resin is preferably from 40 to 70° C. and more preferably from 40 to 60° C. The weight average molecular weight (Mw) thereof is preferably from 8,000 to 100,000 and more preferably from 10,000 to 80,000.

(Vinyl Resin)

According to a preferred embodiment of the present invention, the binder resin includes a vinyl resin. A vinyl resin does not contain a carbonyl group derived from the ester of polyester, and thus it is hardly affected by ultraviolet rays and yellowing of the binder resin can be suppressed.

In addition, according to a preferred embodiment of the present invention, the binder resin includes a polyester resin and a vinyl resin. As the binder resin includes a polyester resin, the degree of freedom of resin design increases, thus it is easy to adjust various characteristic properties but the carbonyl group derived from the ester of polyester is easily oxidized by ultraviolet rays and thus yellowing of the binder resin is easily caused as described above. In order to cope with this, the toner of the present invention contains an external additive including strontium titanate, and it is thus possible to effectively suppress yellowing of the toner containing a polyester resin to be originally easily oxidized by ultraviolet rays as a binder resin. Hence, according to the present embodiment, it is possible to simultaneously have the advantages of both a polyester resin and a vinyl resin. Furthermore, when a crystalline polyester resin is contained, the toner also has a technical effect that the degree of initial whiteness increases.

The vinyl resin is not particularly limited as long as it is a polymer obtained by polymerizing a vinyl compound, and examples thereof may include an acrylic acid ester resin, a styrene-acrylic copolymer, and an ethylene-vinyl acetate resin. These may be used singly or in combination of two or more kinds thereof. Among the vinyl resins described above, a styrene-acrylic copolymer is preferable in consideration of the manufacturability (that is, a toner having sharp particle size distribution can be obtained as a latex having uniform aggregability is formed) of the emulsion aggregation method and the plasticity at the time of heat fixing.

Incidentally, as the vinyl resin, the glass transition temperature (Tg) of is preferably from 40 to 70° C. and more preferably from 40 to 60° C. In addition, the weight average molecular weight (Mw) is preferably from 8,000 to 100,000 and more preferably from 10,000 to 80,000.

(Styrene-Acrylic Copolymer)

The styrene-acrylic copolymer is preferably those formed by polymerizing at least a styrene monomer and a (meth) acrylic acid ester monomer. Here, the styrene monomer also includes those having a structure having a known side chain or functional group in the styrene structure in addition to styrene represented by a structural formula of $CH_2{=}CH{-}C_6H_5$.

In addition, a (meth)acrylic acid ester monomer is those having a functional group having an ester bond on the side chain. Specifically, the (meth)acrylic acid ester monomer includes a vinyl-based ester compound such as a methacrylic acid ester monomer represented by $CH_2{=}C(CH_3)COOR$ (R is an alkyl group) in addition to an acrylic acid ester monomer represented by $CH_2{=}CHCOOR$ (R is an alkyl group).

Specific examples of the styrene monomer and the (meth) acrylic acid ester monomer which can form a styrene-acrylic copolymer are described below but are not limited to those described below.

Examples of the styrene monomer may include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene.

In addition, as the (meth)acrylic acid ester monomer, the following acrylic acid ester monomers and methacrylic acid ester monomers are representative. Examples of the acrylic acid ester monomer may include methyl acrylate, ethyl acrylate, n-propyl acrylate, isopropyl acrylate, n-butyl acrylate, isobutyl acrylate, t-butyl acrylate, n-octyl acrylate, 2-ethylhexyl acrylate, stearyl acrylate, lauryl acrylate, and phenyl acrylate. Examples of the methacrylic acid ester monomer may include methyl methacrylate, ethyl methacrylate, n-propyl methacrylate, isopropyl methacrylate, n-butyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

These styrene monomers and (meth)acrylic acid ester monomers may be used singly or in combination of two or more kinds thereof.

In addition, the styrene-acrylic copolymer also include those formed by concurrently using a common vinyl monomer in addition to these styrene monomers and (meth)acrylic acid ester monomers other than the copolymers formed only of the styrene monomers and (meth)acrylic acid ester monomers described above. Hereinafter, the vinyl monomer that can be concurrently used when forming the styrene-acrylic copolymer referred to in the present invention is preferably a vinyl monomer having a carboxyl group. Specific examples of the vinyl monomer having a carboxyl group may include acrylic acid, methacrylic acid, maleic acid, itaconic acid, cinnamic acid, fumaric acid, a monoalkyl ester of methacrylic acid, and a monoalkyl ester of itaconic acid.

The method of forming the vinyl resin is not particularly limited, and examples thereof may include a method in which a monomer is polymerized by using a known oil-soluble or water-soluble polymerization initiator.

Specific examples of the oil-soluble polymerization initiator may include the following azo-based or diazo-based polymerization initiators and peroxide-based polymerization initiators.

Examples of the azo-based or diazo-based polymerization initiator may include 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide-based polymerization initiator may include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane, and tris(t-butylperoxy)triazine.

In addition, a water-soluble polymerization initiator can be used in the case of forming the resin particles by an emulsion polymerization method.

Examples of the water-soluble polymerization initiator may include persulfates such as potassium persulfate (potassium peroxodisulfate) and ammonium persulfate, any azobisaminodipropane acetate salt, azobiscyanovaleric acid and any salt thereof, and hydrogen peroxide.

For example, a known chain transfer agent such as n-octyl-3-mercaptopropionate or n-octyl mercaptan may be used if necessary. In addition, a known surfactant such as sodium dodecyl sulfate or sodium polyoxyethylene (2) dodecyl ether sulfate may be used. Incidentally, the polymerization may be completed by one stage polymerization or the polymerization may be conducted plural times.

<Titanium Oxide>

The white toner base particles of the present invention contain titanium oxide having an average particle size of from 130 to 600 nm. The average particle size of titanium oxide is the "number average particle size", and the measuring method thereof is the same as that described in Examples. It is possible to obtain a toner capable of forming an image with a high degree of whiteness by using such titanium oxide. Meanwhile, as described above, titanium oxide exhibits high photocatalytic activity and generates radicals when absorbing ultraviolet rays to decompose the binder resin around the pigment, and it is thus considered that deterioration such as yellowing of the image is caused. In the present invention, it is possible to decrease ultraviolet rays reaching the pigment (titanium oxide) present inside the toner by using strontium titanate having ultraviolet absorbing ability as an external additive of the outermost layer of the toner base particles. As a result, it is considered that it is possible to obtain a white toner capable of forming an image having a high degree of whiteness and suppressed yellowing deterioration due to ultraviolet rays.

Titanium oxide contained in the white toner base particles of the present invention has an average particle size of from 130 to 600 nm, but it is concerned that the surface area in contact with the binder resin increases and deterioration of the binder resin is not thus suppressed when the average particle size is less than 130 nm. On the other hand, it is concerned that the hiding power decreases and a sufficient degree of whiteness is not thus obtained when the average particle size is more than 600 nm. The average particle size of titanium oxide contained in the white toner base particles of the present invention is preferably from 140 to 550 nm and more preferably from 150 to 500 nm. It is possible to efficiently achieve the desired effect of the present invention when the average particle size is in such a range.

<Method of Measuring Average Particle Size of Titanium Oxide in Toner Particle>

Incidentally, the average particle size of titanium oxide can be calculated even after being formed into a "toner". The number average particle size of titanium oxide contained in the toner is measured by observing the cross section of the toner particle. The cross section of the toner particles can be observed by using a transmission electron microscope, an electron microscope, a scanning probe microscope (SPM), or the like. An example of observation is described below, but it is not limited to this as long as observation equivalent to this is possible.

(Method of Fabricating Slice of Toner Particle)

After 3 parts by mass of the fabricated toner particles is added to and dispersed in 35 parts by mass of a 0.2% aqueous solution of polyoxyethyl phenyl ether, treated at 25° C. for 5 minutes by ultrasonic waves (US-1200T manufactured by NISSEI Corporation) to remove the external additive from the surface of the toner base particles, thereby obtaining toner particles for observation. Into a 10 mL sample bottle, 1 to 2 mg of the toner particles thus obtained were put so as to be spread therein, stained under the ruthenium tetroxide ($RuO_4$) vapor staining condition, and then dispersed in a photocurable resin "D-800" (manufactured by JEOL Ltd.) and the resin is photo-cured to form a block. Subsequently, a thin slice is fabricated by using the following FIB processing apparatus, and the cross section thereof is then observed.

(Ruthenium Tetroxide Staining Condition)

The staining is conducted by using a vacuum electron staining apparatus VSC 1R1 (manufactured by Filgen, Inc.). According to the apparatus procedure, a sublimation chamber containing ruthenium tetroxide is installed in the staining apparatus main body, and the toner particles described above are introduced into the staining chamber and then stained under the condition of room temperature (24 to 25° C.), a concentration of 3 (300 Pa), and the time of 10 minutes as the ruthenium tetroxide staining condition.

(FIB Processing)

The FIB processing is conducted under the following apparatus conditions.

Apparatus: SMI 2050 manufactured by SII

Processing ion: (Ga 30 kV)

Thickness of sample: 200 nm to 250 nm.

(Observation of Cross Section of Toner)

The cross section of the toner is observed by using a transmission electron detector of an electron microscope "JSM-7401F" (manufactured by JEOL Ltd.). Titanium oxide does not transmit electron beams, and titanium oxide can be thus distinguished as a black domain. Furthermore, elemental analysis of titanium is conducted by EDS to identify the titanium oxide particles. Thereafter, the number average particle size of titanium oxide is calculated by the method described in Examples.

<Crystal Structure of Titanium Oxide>

There are titanium oxides having crystal structures such as a rutile type (tetragonal type), an anatase type, and a brookite type, but any crystal substance may be used as long as the degree of whiteness can be secured.

Incidentally, the white toner base particles of the present invention may contain a pigment (colorant) other than titanium oxide, and examples of such a pigment (colorant) may include inorganic pigments such as heavy calcium carbonate, light calcium carbonate, aluminum hydroxide, titanium white, talc, calcium sulfate, barium sulfate, zinc oxide, magnesium oxide, magnesium carbonate, amorphous silica, colloidal silica, white carbon, kaolin, calcined kaolin, delaminated kaolin, aluminosilicate, sericite, bentonite, and smectite; and organic pigments such as polystyrene resin particles and urea-formalin resin particles. In addition, examples thereof may also include a pigment having a hollow structure (for example, an inorganic pigment such as hollow silica). Pigments other than titanium oxide may be used singly or as a mixture of two or more kinds thereof.

In a preferred embodiment of the present invention, titanium oxide described above has a surface treatment layer of an inorganic compound. Incidentally, an "average particle size of from 130 to 600 nm" in the present invention is judged including the surface treatment layer in a case in which titanium oxide has a surface treatment layer of an inorganic compound.

Here, it is possible to suppress the photocatalytic activity of titanium oxide itself and thus to suppress deterioration of the binder resin by treating the surface of titanium oxide with an inorganic compound. Hence, a synergistic effect is obtained in the present invention by concurrently using titanium oxide with the configuration of strontium titanate. Furthermore, when the surface of white pigment is treated with an inorganic compound, photocatalytic activity can be suppressed but moisture contained in the air is likely to be adsorbed to the metal portion and the charging property of the toner decreases particularly in a high temperature and high humidity environment in some cases. With regard to this, a synergistic effect of improving charging property at a high temperature and a high humidity is obtained by frictional charging caused by positively chargeable strontium titanate.

The kind of the inorganic compound is not particularly limited, but the inorganic compound includes at least one kind selected from the group consisting of Si, Al, Zr, and Zn in a preferred embodiment of the present invention. The dispersibility of titanium oxide in the toner base particles is favorable by selecting the inorganic compound from among these, and the dispersibility is even more favorable by selecting Al in particular.

The content of titanium oxide in the white toner base particles of the present invention is also not particularly limited, but titanium oxide is preferably from 15 to 44 parts by mass, more preferably from 20 to 40 parts by mass, and still more preferably from 22 to 30 parts by mass with respect to 100 parts by mass of the white toner base particles excluding titanium oxide. It is possible to achieve both realization of a high degree of whiteness and suppression of image defects in the HH environment at a high level when the content is in such a range (particularly, 20 to 40 parts by mass). By setting the content of titanium oxide in the white toner base particles as described above, it is possible to secure a sufficient hiding power and to improve the degree of initial whiteness and, meanwhile, it is possible to suppress a decrease in resistance of the toner base particles and to enhance the charging property in the HH environment.

Incidentally, the method of forming a surface treatment layer of an inorganic compound on titanium oxide is also not particularly limited, and for example, the technology described in JP 2010-17863 A and the like may be adopted or a commercially available product may be purchased if there is.

<Strontium Titanate>

The toner for developing an electrostatic image of the present invention contains an external additive including strontium titanate. It is possible to decrease ultraviolet rays reaching titanium oxide present inside the toner by using strontium titanate having ultraviolet ray absorbing ability as an external additive (ultraviolet absorber) of the white toner base particles. As a result, it is possible to form an image having a high degree of whiteness and suppressed yellowing deterioration due to ultraviolet rays.

The ultraviolet absorbing ability in the present invention is preferably to have an action of absorbing light in a band corresponding to any part of a wavelength range of from 340 nm to 390 nm. In addition, as a substance having ultraviolet absorbing ability, a metal oxide exhibiting properties of a semiconductor having a band gap in the vicinity of 3.1 eV is suitable, and examples of such a metal oxide may include titanium oxide, zinc oxide, cerium oxide, tungsten trioxide, and strontium titanate.

However, it has been found that the degree of initial whiteness is poor and the intended object of the present invention cannot be achieved when cerium oxide or tungsten trioxide is used among these. Meanwhile, the degree of whiteness is more favorable when zinc oxide is used as compared to cerium oxide and tungsten trioxide, but the intended object of the present invention cannot be still achieved. In addition, it has been found that the object of the present application cannot be achieved when titanium oxide is used since the positive charging property of titanium oxide itself is insufficient.

Based on the above findings, it is possible to form an image having a high degree of whiteness and suppressed yellowing deterioration due to ultraviolet rays by including strontium titanate which exhibits high positive charging property but does not impair the degree of whiteness. Consequently, it is important to use strontium titanate as an ultraviolet absorber in the present invention.

Hence, according to another aspect of the present invention, the present invention is also characterized in that strontium titanate is used as an ultraviolet absorber (ultraviolet blocking agent) of toner base particles. Consequently, a method of suppressing yellowing of a binder resin in a toner for developing an electrostatic image by adding an ultraviolet absorber (ultraviolet blocking agent) including strontium titanate to white toner base particles containing a binder resin and titanium oxide having an average particle size of from 130 to 600 nm is also provided.

Incidentally, the average particle size of strontium titanate is not particularly limited, but the average particle size of strontium titanate is preferably from 400 to 2600 nm, more preferably from 450 to 2300 nm, and still more preferably from 500 to 2000 nm. Hence, according to a preferred embodiment of the present invention, the average particle size of strontium titanate is from 500 to 2000 nm. Incidentally, the average particle size of strontium titanate is the "number average particle size", and the measuring method thereof is based on the method described in Examples. Strontium titanate exhibits high positive charging property, and it is thus considered that strontium titanate can improve the charging property of toner as it is charged by friction with the adjacent negatively chargeable toner in the developer even in a state of being attached to the toner particles when strontium titanate has an average particle size in an appropriate range. In addition, as a result of investigations by the present inventors, particularly strontium titanate having an average particle size of from 500 to 2000 nm is capable of imparting an electric charge to the adjacent negatively chargeable toner by frictional charging, and strontium titanate can be moved to the image together with the toner base particles to which strontium titanate is attached at the time of development and transfer, so that the intended effect of the present invention is likely to be exerted. Incidentally, the average particle size of strontium titanate may be from 600 to 1500 nm, from 650 to 1200 nm, or from 700 to 900 nm. Meanwhile, the force to charge the adjacent toner particles by friction is weak when the average particle size is smaller than 400 nm. On the other hand, when it is larger than 2600 nm, strontium titanate cannot be firmly attached to the toner base particles but retains in the developing device, and it is considered that the intended effect of the present invention cannot be achieved although it may be considered that strontium titanate is adopted from another viewpoint, for example, as a polishing agent (cleaning auxiliary). In addition, the carrier charging performance decreases as strontium titanate contaminates the surface of the carrier in some cases.

Consequently, it is possible to efficiently achieve the intended effect of the present invention by designing the average particle size of strontium titanate to be small to some extent from the viewpoint of adhesive strength.

In addition, the content of strontium titanate is not particularly limited, but it is contained at preferably from 0.09 to 12 parts by mass, more preferably from 0.1 to 10 parts by mass, and still more preferably from 0.3 to 8.0 parts by mass with respect to 100 parts by mass of the white toner base particles. Incidentally, the content of strontium titanate may be from 0.4 to 5.0 parts by mass and preferably from 0.5 to 2.0 parts by mass with respect to 100 parts by mass of the white toner base particles. The ultraviolet absorbing ability is reliably secured particularly by setting the content to 0.1 parts by mass or more, and an excessive decrease in charge amount of the toner base particles themselves to which strontium titanate is attached is suppressed and the image in the HH environment is improved by setting the content to 10 parts by mass or less.

In addition, according to a preferred embodiment of the present invention, the adhesive strength of strontium titanate is 30% or more and more preferably more than 30%. It is still more preferably 40% or more, yet still more preferably 50% or more, and particularly preferably 60% or more. The upper limit is also not particularly limited, but it is realistically about 95% or less and about 90% or less. There is an effect of easily moving strontium titanate to the image together with the toner base particles to which strontium titanate is attached at the time of development and transfer particularly by setting the adhesive strength of strontium titanate to more than 30%. In other words, retention of strontium titanate in the developing device is suppressed so that contamination of the surface of carrier and a decrease in carrier charging performance are suppressed. Incidentally, the adhesive strength of strontium titanate can be measured, for example, by the method described in Examples.

(Method of Controlling Adhesive Strength)

In the present invention, it is particularly preferable to control the adhesive strength of strontium titanate in order to use strontium titanate as an ultraviolet absorber (ultraviolet blocking agent) of the toner base particles as described above. Hence, with regard to the method of controlling the adhesive strength, for example, the adhesive strength can be controlled by carrying out a step of externally adding strontium titanate to the toner base particles in advance before the external additives other than strontium titanate are externally added to the toner base particles and appropriately setting the conditions for the step or appropriately designing the binder resin. In particular, it is more preferable to firmly externally adding strontium titanate to toner base particles before externally adding external additives other than strontium titanate for controlling the adhesive strength without allowing other fine external additives to enter the adhesion interface between the toner base particles and strontium titanate.

As the condition when firmly externally adding strontium titanate to the toner base particles, strontium titanate is added to the toner base particles, the circumferential velocity of the tip of the blade is then designed to be preferably from 40 to 70 m/s and more preferably from 40 to 65 m/s, and the mixture is mixed for preferably from 15 to 60 minutes and more preferably from 15 to 45 minutes by using a fluidized mixer with blade such as a Henschel mixer.

In addition, the temperature at the time of externally adding strontium titanate is set to preferably from 30 to 60° C. and more preferably from 40 to 55° C. Incidentally, the set temperature may be maintained by changing the flow velocity of the cooling water.

The circumferential velocity of the tip of the blade, the mixing time, and the temperature in the condition described above are higher than those in the general condition for external addition of inorganic particles to the toner base particles, and it is thus possible to firmly externally add strontium titanate to the toner base particles.

<Internal Additive>

The white toner base particles of the present invention may contain known internal additives. The internal additives are not particularly limited, but examples thereof may include a mold releasing agent and a charge control agent.

(Mold Releasing Agent)

As the mold releasing agent, various known waxes can be used.

Examples of waxes may include a polyolefin wax such as polyethylene wax or polypropylene wax, a branched chain hydrocarbon wax such as microcrystalline wax, a long chain hydrocarbon-based wax such as paraffin wax or sasol wax, a dialkyl ketone-based wax such as distearyl ketone, carnauba wax, montan wax, an ester-based wax such as behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, or distearyl maleate, and an amide-based wax such as ethylenediamine behenyl amide or trimellitic acid tristearyl amide.

The content of the mold releasing agent is preferably from 3 to 30 parts by mass and more preferably from 4 to 20 parts by mass with respect to 100 parts by mass of the binder resin.

(Charge Control Agent)

The charge control agent is not particularly limited as long as it is a substance capable of positively or negatively charging the toner by frictional charging, and various known positive charge control agents and negative charge control agents can be used.

The content of the charge control agent is preferably from 0.01 to 30 parts by mass and more preferably from 0.1 to 10 parts by mass with respect to 100 parts by mass of the binder resin.

<Particle Size of Toner Base Particle>

The particle size of the toner base particles to which the external additive is added is preferably from 3 to 8 μm in terms of a volume median diameter (D50). This particle size can be controlled by the concentration of the aggregating agent, the fusion time, and the composition of the polymer itself. It is possible to achieve fine line reproducibility and high image quality of a photographic image as the volume median diameter (D50) is from 3 to 8 μm. Incidentally, the volume median diameter (D50) can be measured by using, for example, "MULTISIZER 3" (manufactured by Beckman Coulter, Inc.).

<External Additive>

It is possible to add external additives other than strontium titanate to the toner base particles for the purpose of improving fluidity and charging property. By adding an external additive to the toner base particles, the toner base particles become a toner.

Examples of the external additive may include inorganic particles having a number average primary particle size of from 5 to 200 nm such as inorganic oxide particles such as silica particles, alumina particles, and titanium oxide particles and inorganic titanate compound particles such as zinc titanate.

From the viewpoint of heat resistant storage property and environmental stability, the surface may be subjected to a hydrophobic treatment with a known surface treatment agent such as a coupling agent, and examples of the surface treatment agent may particularly preferably include dimethyldimethoxysilane, hexamethyldisilazane (HMDS), methyltrimethoxysilane, isobutyltrimethoxysilane, and decyltrimethoxysilane. The hydrophobicity is preferably about from 30 to 90.

<Method of Producing Toner>

The method of producing the toner according to the present invention is not particularly limited, and examples thereof may include known methods such as a kneading pulverization method, a suspension a polymerization method, an emulsion aggregation method, a dissolution suspension method, a polyester elongation method, and a dispersion polymerization method. Among these, it is preferable to employ an emulsion aggregation method from the viewpoint of uniformity of particle size, controllability of shape, and the like. Hereinafter, the emulsion aggregation method will be described.

The emulsion aggregation method is a method in which dispersions of components constituting toner base particles such as a dispersion of binder resin fine particles, a dispersion of pigment fine particles, and a dispersion of mold releasing agent are mixed in an aqueous environment, these are aggregated by adding an aggregating agent to the mixture, the particle size is controlled by adding an aggregation terminator, if necessary, and the shape is controlled by fusion, and the toner base particles can be thus produced.

Incidentally, a known surfactant (for example, an anionic surfactant such as sodium alkyl diphenyl ether disulfonate, sodium polyoxyethylene lauryl ether sulfate, or sodium lauryl sulfate (sodium dodecyl sulfate)) may be appropriately added in any of the dispersions in advance for dispersion. In addition, the dispersion of binder resin fine particles may be prepared by adjusting the degree of neutralization to a desired level.

Subsequently, the binder resin fine particles, the mold releasing agent, and the pigment fine particles are aggregated in an aqueous medium, and these particles are fused, thereby fabricating the toner base particles. At this time, these may be aggregated collectively or in an arbitrary order.

In a preferred form, an alkali metal salt, an alkaline earth (Group 2) metal salt, or the like is added to an aqueous medium in which a dispersion of binder resin fine particles, a dispersion of mold releasing agent, and a dispersion of pigment fine particles are mixed as an aggregating agent, and the fusion is advanced. Incidentally, the mold releasing agent may be contained in the binder resin in advance.

A more specific operation will be described. It is preferable that the pH of the components is adjusted to from 1.5 to 3.0 by adding a known acid such as nitric acid. Subsequently, it is preferable that the components are dispersed at a speed of rotation of from 5000 to 9000 rpm by using a known stirring device (for example, a homogenizer) and the aggregating agent is added thereto over from 5 to 20 minutes. Thereafter, it is preferable to raise the temperature until the particle size reaches the intended volume average particle size (for example, 5.0 to 7.0 μm) while appropriately adjusting the temperature and the rate of temperature rise. More specifically, it is preferable that the temperature is raised at a rate of temperature rise of from 0.1 to 0.3° C./min until it reaches 40° C. and the temperature is raised at a rate of temperature rise of from 0.02 to 0.08° C./min after the temperature reaches 40° C. Thereafter, a dispersion of binder resin for forming a shell is added in the case of forming toner base particles having a core/shell structure. Thereafter, the pH is adjusted to from 7.5 to 9.5, aging is conducted until the shape of the toner base particles has a desired shape (fusion is advanced), whereby the toner base particles are completed. As the aging treatment, the mixture was heated and stirred for from 0.5 to 6 hours by setting the rate of temperature rise to from 0.5 to 2° C./min and the liquid temperature to from 70 to 90° C. to advance the fusion of particles until the average circularity reaches usually 0.91 or more and preferably from 0.920 to 0.996. Thereafter, it is preferable to gradually cool the resultant mixture. Moreover, classification, pH adjustment, and filtration are conducted if necessary, this operation is repeatedly conducted for washing until the electrical conductivity of the filtrate reaches, for example, 15 μS/cm or less, pulverization is conducted if necessary, and drying is conducted, whereby the toner base particles of the present invention can be obtained.

Incidentally, in the aging step, it is possible to control the circularity and the surface property of the particles as well as to fuse the resin fine particles in the aggregated particles by applying shear caused by heat and stirring to the toner particles.

(Aggregating Agent)

The aggregating agent for promoting aggregation is not particularly limited, but one selected from metal salts is suitable as a material for growing particles by using a charge neutralization reaction and a crosslinking action. Examples of the metal salt may include monovalent metal salts such as salts of alkali metals such as sodium, potassium, and lithium; divalent metal salts such as salts of calcium, magnesium, manganese, and copper; and trivalent metal salts such as salts of iron and aluminum.

Specific examples of the metal salt may include sodium chloride, potassium chloride, lithium chloride, calcium chloride, magnesium chloride, zinc chloride, copper sulfate, magnesium sulfate, manganese sulfate, aluminum sulfate, polyaluminum chloride, and zinc acetate. These may be used singly or in combination of two or more kinds thereof.

As described above, the toner base particles may be fabricated by the emulsion aggregation method. In that case, the shape of the toner base particles (toner) to be fabricated is close to a true sphere. The average circularity (also simply referred to as circularity) of the toner base particles represented by the following Mathematical Formula 1 is preferably 0.910 or more. In addition, it is more preferably from 0.920 to 0.996 from the viewpoint of improving transfer efficiency and of charging stability.

[Mathematical Formula 1]

Average circularity=circumference of circle determined from diameter of equivalent circle/circumference of projected image of particle Mathematical Formula 1

Incidentally, the average circularity is measured according to the method described in Examples.

The toner base particles can be fabricated in this manner.

(Addition of External Additive)

Toner (toner particles) can be fabricated by fabricating toner base particles as described above and adding an external additive to the toner base particles by a known method (for example, mixing by a Henschel mixer or the like). As the conditions at this time, the above description on the method of controlling the adhesive strength may be adopted.

<Developer>

The toner of the present invention is used, for example, as a one-component magnetic toner by containing a magnetic substance, as a two-component developer by being mixed with a so-called carrier, or singly as a nonmagnetic toner, and the toner can be suitably used in any of the cases.

As the carrier constituting the two-component developer, magnetic particles prepared from a conventionally known material such as a metal such as iron, ferrite, or magnetite or any alloy of these metals with a metal such as aluminum or lead can be used, and it is particularly preferable to use ferrite.

As the carrier, those having a volume average particle size of from 15 to 100 μm are preferable and those having a volume average particle size of from 25 to 60 μm are more preferable.

As the carrier, it is preferable to use those covered with a resin or a so-called dispersed in resin type carrier in which magnetic particles are dispersed in a resin. The composition of resin for covering is not particularly limited, but an olefin resin, a cyclohexyl methacrylate-methyl methacrylate copolymer, a styrene resin, a styrene-acrylic resin, a silicone resin, a polyester resin, and a fluorocarbon resin is used. In addition, the resin for constituting the dispersed in resin type carrier is not particularly limited, and known resins can be used, for example, an acrylic resin, a styrene-acrylic resin, a polyester resin, a fluorocarbon resin, and a phenol resin can be used.

EXAMPLES

Hereinafter, the present invention will be further described with reference to representative embodiments of the present invention, but it is needless to say that the present invention is not limited to these embodiments. Incidentally, in Examples, "parts" means "parts by mass" and "%" means "% by mass" unless otherwise stated.

<<Preparation of Aqueous Dispersion (W1 to W6) of White Pigment>>

To 1,600 parts by mass of ion exchanged water, 90 parts by mass of sodium dodecyl sulfate was added. While stirring this solution, 700 parts by mass of rutile type titanium oxide having the surface treated with alumina and an average particle size of 100 nm was gradually added thereto and subsequently dispersed by using a stirring device "CLEARMIX" (manufactured by M Technique Co., Ltd.), thereby preparing an aqueous dispersion (W1) of rutile type titanium oxide having the surface treated with alumina and an average particle size of 100 nm.

An aqueous dispersion (W2) of rutile type titanium oxide having the surface treated with alumina and an average particle size of 150 nm, an aqueous dispersion (W3) of rutile type titanium oxide having the surface treated with alumina and an average particle size of 300 nm, an aqueous dispersion (W4) of rutile type titanium oxide having the surface treated with alumina and an average particle size of 500 nm, an aqueous dispersion (W5) of rutile type titanium oxide having the surface treated with alumina and an average particle size of 700 nm were obtained in the same manner.

In addition, titanium oxide having an average particle size of 300 nm was subjected to the same treatment without treating the surface to obtain an aqueous dispersion (W6) of 300 nm rutile type titanium oxide without surface treatment.

TABLE 1

| | Average particle size [nm] | Surface treatment |
|---|---|---|
| W1 | 100 | Alumina |
| W2 | 150 | Alumina |
| W3 | 300 | Alumina |
| W4 | 500 | Alumina |
| W5 | 700 | Alumina |
| W6 | 300 | Absence |

Incidentally, the average particle size of the rutile type titanium oxide having the surface treated with alumina was determined as a diameter of an equivalent circle by photographing the titanium oxide powder by using a transmission electron microscope (TEM) and calculating the size by using an image processing analyzer LUZEX AP (manufactured by Nireco Corporation). More specifically, 100 particles were randomly chosen and the size was calculated as an arithmetic mean value, thereby determining the number average particle size of titanium oxide.

<<Production of Toner Base Particle (1)>>

<Synthesis of Crystalline Resin (Crystalline Polyester Resin)>

Into a reaction vessel equipped with a stirring device, a temperature sensor, a condenser tube, and a nitrogen introducing device, 258.0 parts by mass of a polycarboxylic acid: octanedioic acid (molecular weight: 174.2) and 192.0 parts by mass of a polyhydric alcohol: 1,8-octanediol (molecular weight: 146.2) were put.

Thereto, 0.7 parts by mass of dibutyltin oxide as a catalyst and 0.4 parts by mass of hydroquinone were added, and the mixture was reacted at 170° C. for 5 hours in a nitrogen gas atmosphere. Furthermore, the reaction was conducted at 170° C. until a resin having a desired melting point was obtained at 3.3 kPa, thereby obtaining a crystalline resin (C1).

This crystalline resin (C1) was subjected to the measurement by DSC at a rate of temperature rise of 10° C./min. As a result, the crystalline resin (C1) had a weight average molecular weight of 15,000 and a clear peak and the temperature of the peak top was 70° C. Incidentally, a clear peak means a peak having a half-value width of temperature within 15° C.

<Preparation of Aqueous Dispersion of Crystalline Resin Fine Particle (Crystalline Polyester Resin Fine Particle)>

The crystalline resin (C1) was melted by 300 parts by mass and transported to an emulsifying and dispersing machine "CAVITRON CD 1010" (manufactured by EUROTEC, LTD.) at a flow velocity of 100 parts by mass per minute in the molten state. In addition, simultaneously with the transportation of this crystalline resin (C1) in the molten state, diluted ammonia water which was obtained by diluting reagent ammonia water with ion exchanged water in an aqueous solvent tank and thus had a concentration of 0.37% by mass was transported to the emulsifying and dispersing machine at a flow velocity of 0.1 liter per minute while heating to 100° C. by using a heat exchanger. Thereafter, this emulsifying and dispersing machine was operated under the condition in which the speed of rotation of a rotor was 60 Hz and the pressure was 5 kg/cm$^2$, thereby preparing a crystalline resin fine particle dispersion (CA-1). Incidentally, the diluted ammonia water was added so that the degree of neutralization was 54%. The dispersed particle size of the crystalline resin fine particles in the crystalline resin fine particle dispersion (CA-1) was 151.0 nm in terms of a volume median diameter.

Incidentally, the value determined by converting the amount of ammonia water used for neutralization into the mass (g) of potassium hydroxide (KOH) to be used for neutralization and then conducting the calculation by the following mathematical formula was taken as the degree of neutralization (%).

Degree of neutralization (%)=[(amount of KOH used for neutralization [g])/(amount of KOH required for entire neutralization of terminal of crystalline resin (crystalline polyester resin) [g])]×100

<Synthesis of Amorphous Resin (Amorphous Polyester Resin)>

Into a reaction vessel equipped with a stirrer, a thermometer, a condenser tube, and a nitrogen gas introducing tube, 112 parts by mass of terephthalic acid (TPA), 6 parts by mass of trimellitic acid (TMA), 12 parts by mass of fumaric acid (FA), 60 parts by mass of adipic acid, 290 parts by mass of bisphenol A propylene oxide adduct (BPA.PO), and 55 parts by mass of bisphenol A ethylene oxide adduct (BPA.EO) were put, the interior of the reaction vessel was purged with dry nitrogen gas, 0.1 parts by mass of titanium tetrabutoxide was then added into the reaction vessel, and the polymerization reaction was conducted for 9 hours while stirring at 180° C. in a nitrogen gas stream. Furthermore, 0.2 parts by mass of titanium tetrabutoxide was added to the reaction mixture, and the temperature was raised to 220° C., and the polymerization reaction was conducted for 6 hours while stirring, the internal pressure of the reaction vessel was then decreased to 1333.2 Pa, and the reaction was conducted under reduced pressure, thereby obtaining an amorphous resin (A1).

This amorphous resin (A1) had a glass transition temperature (Tg) of 53° C. and a weight average molecular weight (Mw) of 25,000.

<Preparation of Aqueous Dispersion of Amorphous Resin Fine Particle (Amorphous Polyester Resin Fine Particle)>

In 200 parts by mass of ethyl acetate, 200 parts by mass of the amorphous resin (A1) was dissolved and then mixed with an aqueous solution prepared by dissolving sodium polyoxyethylene lauryl ether sulfate in 800 parts by mass of ion exchanged water so as to have a concentration of 1.3% by mass, and the mixture was dispersed by using an ultrasonic homogenizer. Ethyl acetate was removed from this solution under reduced pressure, and the solid concentration of the solution was then adjusted to 20% by mass. An amorphous resin fine particle dispersion (AA-1) in which fine particles of the amorphous resin (A1) were dispersed in an aqueous medium was thus prepared. The volume median diameter of the fine particles of the amorphous resin (A1) in the dispersion was 200 nm.

<Preparation of Aqueous Dispersion of Amorphous Resin Fine Particle (WAX-Containing StAc Resin Fine Particle)>

[First Stage Polymerization]

Into a 5 L reaction vessel equipped with a stirring device, a temperature sensor, a condenser tube, and a nitrogen introducing device, 8 parts by mass of sodium dodecyl sulfate and 3000 parts by mass of ion exchanged water were put, the internal temperature of the reaction vessel was raised to 80° C. while stirring the mixture at a rate of stirring of 230 rpm in a nitrogen stream. After the temperature was raised, a solution prepared by dissolving 10 parts by mass of potassium persulfate in 200 parts by mass of ion exchanged water was added into the reaction vessel, the liquid temperature was raised again to 80° C., a mixed monomer liquid composed of 480 parts by mass of styrene, 250 parts by mass of n-butyl acrylate, 68 parts by mass of methacrylic acid, and 2.1 parts by mass of n-octyl-3-mercaptopropionate was added into the reaction vessel dropwise over 1 hour, and the polymerization was then conducted by heating and stirring this system at 80° C. for 2 hours, thereby preparing a resin fine particle dispersion (×1).

[Second Stage Polymerization]

Into a 5 L reaction vessel equipped with a stirring device, a temperature sensor, a condenser tube, and a nitrogen introducing device, a solution prepared by dissolving 7 parts by mass of sodium polyoxyethylene (2) dodecyl ether sulfate in 2000 parts by mass of ion exchanged water was put and heated to 98° C., a solution prepared by dissolving the monomers composed of 260 parts by mass of the resin fine particle dispersion (×1), 284 parts by mass of styrene (St), 142 parts by mass of n-butyl acrylate (BA), 6 parts by mass of methacrylic acid (MAA), 1.5 parts by mass of n-octyl-3-mercaptopropionate and a mold releasing agent: 190 parts by mass of behenyl behenate (melting point: 73° C.) at 90° C. was then added into the reaction vessel, and the mixture was mixed and dispersed for 1 hour by using a mechanical dispersing machine "CLEARMIX" (manufactured by M Technique Co., Ltd.) having a circulation path, thereby preparing a dispersion containing emulsified particles (oil droplets).

Subsequently, an initiator solution prepared by dissolving 6 parts by mass of potassium persulfate in 200 parts by mass of ion exchanged water was added to this dispersion, and the polymerization was conducted by heating and stirring this system at 84° C. for 1 hour, thereby preparing a resin fine particle dispersion (×2).

[Third Stage Polymerization]

Furthermore, a solution prepared by dissolving 11 parts by mass of potassium persulfate in 400 parts by mass of ion exchanged water was added to the resin fine particle dispersion (×2), and a mixed monomer liquid composed of 350 parts by mass of styrene (St), 155 parts by mass of n-butyl acrylate (BA), 37 parts by mass of acrylic acid (AA), and 15 parts by mass of n-octyl-3-mercaptopropionate was added to the mixture dropwise over 1 hour under a temperature condition of 82° C. After the dropwise addition was completed, the polymerization was conducted by heating and stirring this system for 2 hours. The resultant mixture was then cooled to 28° C., and a 5 mol/liter aqueous solution of sodium hydroxide was added thereto to adjust the pH to 7.0, thereby preparing an aqueous dispersion (SA-1) of amorphous resin fine particles formed of a vinyl resin.

With regard to the aqueous dispersion (SA-1) of amorphous resin fine particles thus obtained, the amorphous resin fine particles had a volume median diameter of 220 nm, a glass transition temperature (Tg) of 55° C., and a weight average molecular weight (Mw) of 27,000.

<Preparation of Mold Releasing Agent Fine Particle Dispersion>

As a mold releasing agent, 200 parts by mass of behenyl behenate (melting point: 73° C.) was melted by heating to 95° C. This was added to an aqueous solution of surfactant prepared by dissolving sodium alkyl diphenyl ether disulfonate in 800 parts by mass of ion exchanged water so as to have a concentration of 3% by mass and dispersed by using an ultrasonic homogenizer. The solid concentration was adjusted to 20% by mass. A mold releasing agent fine particle dispersion (Wax1) in which fine particles of a mold releasing agent were dispersed in an aqueous medium was thus prepared.

The volume median diameter of the fine particles of mold releasing agent in the mold releasing agent fine particle dispersion (Wax1) was measured by using the Microtrac particle size distribution measuring apparatus "Microtrac UPA-150" (manufactured by NIKKISO CO., LTD.), and the result was 150 nm.

<Production of Toner Base Particle 1>

10 parts by mass (in terms of solids) of crystalline resin fine particle dispersion (C1)

71 parts by mass (in terms of solids) of amorphous resin fine particle dispersion (AA-1)

10 parts by mass (in terms of solids) of mold releasing agent fine particle dispersion (Wax1)

25 parts by mass (in terms of solids) of pigment fine particle dispersion (W2: 150 nm, treated)

300 parts by mass of ion exchanged water 4.5 parts by mass of anionic surfactant (DOWFAX 2A1 manufactured by Dow Chemical Company)

The above components were put into a 3 liter reaction vessel equipped with a stirrer, a thermometer, and a pH meter, and 0.3 M nitric acid was added thereto at 25° C. to adjust the pH to 2.5. Subsequently, 60 parts by mass of an aqueous solution of aluminum sulfate (aggregating agent: 0.2975% by mass, solids: 0.18 g) as an aggregating agent was added into the reaction vessel over 10 minutes while dispersing the mixture at 7000 rpm by using a homogenizer (ULTRA-TURRAX T50 manufactured by IKA). Incidentally, the aqueous solution of aluminum sulfate was prepared by putting 35 parts by mass of aluminum sulfate powder (manufactured by Asada Chemical INDUSTRY Co., Ltd.: 17% aluminum sulfate) and 1965 parts by mass of ion exchanged water into a 2 liter container and stirring and mixing these at 30° C. until the precipitate disappeared.

Thereafter, a stirrer and a mantle heater were installed to the reaction vessel, the temperature was raised at a rate of temperature rise of 0.2° C./min until it reached 40° C. and the temperature was raised at a rate of temperature rise of 0.05° C./min after the temperature reached 40° C. while adjusting the speed of rotation of the stirrer so that the slurry was sufficiently stirred, and the volume average particle size was measured every 10 minutes by the Multisizer 3 (aperture diameter: 50 μm, manufactured by Beckman Coulter Inc.). The temperature raising was stopped when the volume average particle size reached 6.0 μm, and 9 parts by mass (in terms of solids) of the amorphous resin fine particle dispersion (AA-1) as a resin fine particle dispersion for shell was added into the reaction vessel dropwise over 1 hour. Thereafter, the pH was adjusted to 8.5 with a 0.5 N aqueous solution of sodium hydroxide. Thereafter, the temperature was raised to 85° C. at a rate of temperature rise of 1° C./min while adjusting in the same manner so as to have a pH of 8.5 every 5° C., the temperature was held at 85° C., the temperature was lowered to 60° C. at 10° C./min at the time point at which the average circularity reached 0.960 by FPIA-2000 (manufactured by Sysmex), and the temperature was then lowered to room temperature (25° C.) at 0.1° C./min. The cooled slurry was allowed to pass through a nylon mesh having an opening of 20 μm to remove coarse particles, and nitric acid was added to the toner slurry passed through the mesh to adjust the pH to 6.0, and the toner slurry was filtered under reduced pressure by using an aspirator. The toner remained on the filter paper was crushed as finely as possible with hand, put into ion exchanged water to be 10-fold the amount of the toner at a temperature of 30° C., stirred and mixed for 30 minutes, and then filtered again under reduced pressure by using an aspirator, and the electrical conductivity of the filtrate was measured. This operation was repeatedly conducted for washing until the electrical conductivity of the filtrate reached 10 μS/cm or less, thereby obtaining a base toner. The base toner was finely pulverized by using a wet and dry type particle size regulator (comill) and then vacuum-dried in an oven at 35° C. for 36 hours, thereby obtaining toner base particles 1. The particle size of these toner base particles was 6.2 μm.

<Production of Toner Base Particles 2 to 4, 11, and 12>

Toner base particles 2 were fabricated in the same manner except that the pigment fine particle dispersion used for the toner base particles was changed to W3. Toner base particles 3 were fabricated by using W4, toner base particles 4 were fabricated by using W6, toner base particles 11 were fabricated by using W1, and toner base particles 12 were fabricated by using W5 in the same manner. The particle sizes of these toner base particles were 6.2 μm.

<Production of Toner Base Particle 5>

10 parts by mass (in terms of solids) of crystalline resin fine particle dispersion (C1)

35 parts by mass (in terms of solids) of amorphous resin fine particle dispersion (SA-1)

41 parts by mass (in terms of solids) of amorphous resin fine particle dispersion (AA-1)

5 parts by mass (in terms of solids) of mold releasing agent fine particle dispersion (Wax1)

25 parts by mass (in terms of solids) of pigment fine particle dispersion (W3: 300 nm, treated)

300 parts by mass of ion exchanged water 4.5 parts by mass of anionic surfactant (DOWFAX 2A1 manufactured by Dow Chemical Company)

The above components were put into a 3 liter reaction vessel equipped with a stirrer, a thermometer, and a pH meter, and 0.3 M nitric acid was added thereto at 25° C. to adjust the pH to 2.5. Subsequently, 60 parts by mass of an aqueous solution of aluminum sulfate (aggregating agent: 0.2975% by mass, solids: 0.18 g) as an aggregating agent was added into the reaction vessel over 10 minutes while dispersing the mixture at 7000 rpm by using a homogenizer (ULTRA-TURRAX T50 manufactured by IKA).

Thereafter, toner base particles 5 were obtained in the same manner as in the method of producing the toner base particles 1 except that 9 parts by mass (in terms of solids) of the amorphous resin fine particle dispersion (SA-1) as a resin fine particle dispersion for shell was added over 1 hour. The particle size of these toner base particles was 6.2 μm.

<Production of Toner Base Particle 6>

10 parts by mass (in terms of solids) of crystalline resin fine particle dispersion (C1)

81 parts by mass (in terms of solids) of amorphous resin fine particle dispersion (SA-1)

25 parts by mass (in terms of solids) of pigment fine particle dispersion (W3: 300 nm, treated)

300 parts by mass of ion exchanged water 4.5 parts by mass of anionic surfactant (DOWFAX 2A1 manufactured by Dow Chemical Company)

The above components were put into a 3 liter reaction vessel equipped with a stirrer, a thermometer, and a pH meter, and 0.3 M nitric acid was added thereto at 25° C. to adjust the pH to 2.5. Subsequently, 60 parts by mass of an aqueous solution of aluminum sulfate (aggregating agent: 0.2975% by mass, solids: 0.18 g) as an aggregating agent was added into the reaction vessel over 10 minutes while dispersing the mixture at 7000 rpm by using a homogenizer (ULTRA-TURRAX T50 manufactured by IKA).

Thereafter, toner base particles 6 were obtained in the same manner as in the production of the toner base particles 5. The particle size of these toner base particles was 6.2 μm.

<Production of Toner Base Particle 7>

81 parts by mass (in terms of solids) of amorphous resin fine particle dispersion (AA-1)

10 parts by mass (in terms of solids) of mold releasing agent fine particle dispersion (Wax1)

25 parts by mass (in terms of solids) of pigment fine particle dispersion (W3: 300 nm, treated)

300 parts by mass of ion exchanged water 4.5 parts by mass of anionic surfactant (DOWFAX 2A1 manufactured by Dow Chemical Company)

Toner base particles 7 were produced in the same manner as in the production of the base particles 1 except that the formulation was changed to the above formulation.

<Production of Toner Base Particle 8>

91 parts by mass (in terms of solids) of amorphous resin fine particle dispersion (SA-1)

25 parts by mass (in terms of solids) of pigment fine particle dispersion (W3: 300 nm, treated)

300 parts by mass of ion exchanged water 4.5 parts by mass of anionic surfactant (DOWFAX 2A1 manufactured by Dow Chemical Company)

Toner base particles 8 were produced in the same manner as in the production of the toner base particles 6 except that the formulation was changed to the above formulation.

<Production of Toner Base Particle 9>

Toner base particles 9 were produced in the same manner as in the production of the toner base particles 2 except that the amount of pigment fine particle dispersion (W3: 300 nm, treated) to be first mixed was changed to 18 parts by mass.

<Production of Toner Base Particle 10>

Toner base particles 10 were produced in the same manner as in the production of the toner base particles 2 except that the amount of pigment fine particle dispersion (W3: 300 nm, treated) to be first mixed was changed to 42 parts by mass. The particle size of these toner base particles was 6.2 μm.

<<Production of White Toner>>

<Production of White Toner 1>

To 100 parts by mass of the toner base particles 1 thus obtained, 1 part by mass of strontium titanate particles having an average particle size of 800 nm was added and fixed onto the toner base particles by being mixed at a circumferential velocity of the tip of the blade of 55 m/s for 20 minutes by using a Henschel mixer. The product temperature at the time of mixing the external additive at this time was set to be 45° C.±1° C., and the internal temperature of the Henschel mixer was controlled by allowing cooling water to flow through the outer bath of the Henschel mixer at a flow rate of 5 L/min in a case in which the temperature reached 46° C. and allowing cooling water to flow at a flow rate of 1 L/min in a case in which the temperature reached 44° C.

Subsequently, 0.3 part of hydrophobic silica fine particles having an average particle size of 20 nm were added to the resultant toner particles and further mixed at 30 m/s for 5 minutes. The product temperature at the time of mixing the external additive at this time was set to be 40° C.±1° C., and the temperature was controlled in the same manner as above in a case in which the temperature reached 41° C. and a case in which the temperature reached 39° C. Thereafter, the resultant toner particles were sieved by using a vibration sieve having an opening of 45 μm, thereby obtaining a white toner 1. The adhesive strength of strontium titanate of this white toner was "70%". The results are presented in Table 2.

<Method of Measuring Average Particle Size of Strontium Titanate Particle>

The number average particle size of strontium titanate externally added to the white toner is measured specifically by the following method.

First, an image was taken at a magnification of 5000-fold by using a scanning electron microscope (SEM). Subsequently, this field of vision was subjected to EDS analysis. At this time, elemental analysis of strontium and titanium was conducted to confirm the strontium titanate particles. The SEM image having strontium titanate confirmed was binarized by using an image processing analyzer LUZEX AP (manufactured by Nireco Corporation). Among the plurality of photographs, the Feret's diameter in the horizontal direction for 100 pieces of strontium titanate was calculated, and the average value thereof was taken as the number average particle size. Here, the Feret's diameter in the horizontal direction refers to the length of the side of the circumscribed rectangle parallel to the x axis when the image of the external additive was binarized. Incidentally, in a case in which the number average primary particle size of strontium titanate was small and strontium titanate was present as an aggregate on the toner surface, the particle size of primary particles forming the aggregate was measured.

<Production of White Toners 2 to 14 and 16 to 24>

White toners 2 to 14 and 16 to 24 were produced in the same manner as above except that the toner base particles used and the average particle size and added amount of the strontium titanate particles were changed as presented in Table 2. The adhesive strength is presented in Table 2 as well.

<Production of White Toner 15>

To 100 parts by mass of the toner base particles 2 thus obtained, 1 part of strontium titanate particles having an average particle size of 800 nm and 0.3 part of hydrophobic silica fine particles having an average particle size (number average primary particle size) of 20 nm were added, and the mixture was mixed at a circumferential velocity of the tip of the blade of 30 m/s for 10 minutes by using a Henschel mixer. The product temperature at the time of mixing the external additives was controlled in the same manner as above, thereby obtaining a white toner 15. The adhesive strength of strontium titanate of this white toner was "30%".

<Production of White Toner 25>

A white toner 25 was produced in the same manner as the white toner 13 except that cerium oxide particles were used instead of the strontium titanate particles.

<<Production of White Toner Developer>>

<Fabrication of Developer>

The white toners 1 to 25 thus fabricated were mixed with a ferrite carrier which had a volume average particle size of 30 μm and was covered with a copolymer resin of cyclohexyl methacrylate with methyl methacrylate (monomer mass ratio=1:1) so as to have a white toner concentration of 6% by mass, thereby fabricating developers 1 to 25, and the developers were subjected to the following evaluations. The mixing was conducted for 30 minutes by using a V-type mixer.

<Adhesive Strength of Strontium Titanate>

The adhesive strength of strontium titanate was measured by the following method.

The adhesive strength of strontium titanate was measured by using the apparatus presented in FIG. 1. First, 1 g of the developer weighed by using a precision balance was placed on the entire surface of a conductive sleeve 3 so as to be uniform. A voltage of 2 kV was supplied from a bias supply 33 to the conductive sleeve 3, and the number of rotation of a magnet roll 32 provided in the conductive sleeve 3 was set to 300 rpm. In this state, the developer was left to stand for 30 seconds so that the toner was collected on a cylindrical electrode 34, and this was recovered from the cylindrical electrode 34 by using a spatula or the like.

In other words, it is considered that the toner thus recovered is the toner base particles and external additive components separated from the developer by applying an electric field in the same manner as to the actual machine and the component to be actually transferred to and fixed on the image. By repeatedly conducting the above operation, about 2 g of component (component (B) separated by the electric field) separated by the electric field was recovered. Subsequently, the toner (A) after completion of the external addition and the component (B) separated by the electric field were subjected to the measurement by WDX (X-ray fluorescence spectrometer), and the net intensity ratio of Sr was taken as the adhesive strength.

$$\text{Adhesive strength (\%)}=(B/A)\times 100 \qquad \text{[Mathematical Formula 2]}$$

<Evaluation Method>

For image output, BIZHUB PRESS C1070 (manufactured by Konica Minolta, Inc.) was used. The white toner and developer adjusted as described above were filled in a toner cartridge and a developing machine to obtain an image forming apparatus for evaluation. As a substrate for forming an evaluation image, mondi 90 was used. As the evaluation image, a solid image (5 cm×2 cm width, output direction: long side) output so that the amount of toner per unit area was 6.0 mg/cm$^2$ was used. The evaluation images obtained by using the respective toners were subjected to the evaluation on the degree of whiteness and the discoloration conducted as follows, thereby evaluating the respective toners. The results are presented in Table 2.

<Evaluation on Degree of Whiteness>

The output image was placed on 10 sheets of white paper (mondi 90) superimposed one on another so that the image surface faced up and subjected to colorimetry by a densitometer FD-7 (manufactured by Konica Minolta, Inc.) to examine the CIE 1976 (L*a*b*) color space. Based on the L* value of the CIE 1976 (L*a*b*) color space thus obtained, the degree of whiteness was evaluated according to the following criteria. The evaluation criteria are as follows, and ⊙ and ○ were judged to be acceptable.

⊙: L* value is 93 or more.

○: L* value is 85 or more and less than 93.

X: L* value is less than 85.

<Evaluation on Discoloration>

The image output above was irradiated with light emitted from the "xenon long life weather meter" (xenon arc lamp, 70,000 lux, 44.0° C.) manufactured by Suga Test Instruments Co., Ltd. for 10 days, and the discoloration was evaluated by a change (ΔE) in color difference before and after irradiation. ΔE=(image color difference E1 before exposure−image color difference E2 after exposure). It is considered that discoloration outdoors by ultraviolet rays is more severe as the value of ΔE is greater. Incidentally, for the evaluation on discoloration, JP 2013-15849 A, JP 2016-69542 A, and the like may be appropriately referred to. The evaluation criteria are as follows, and ⊙ and ○ were judged to be acceptable.

⊙: ΔE is less than 1.5,

○: ΔE is 1.5 or more and less than 6, and

X: ΔE is 6 or more.

<Evaluation on Image Defect in HH Environment>

For image output, BIZHUB PRESS C1070 (manufactured by Konica Minolta, Inc.) was used. First, a manuscript having a coverage rate of 5% was printed 10,000 sheets in a printing environment at a high temperature and a high humidity (30° C. and 85% RH), the same image was then output on black paper, and the contamination due to scattering of the white toner to the background portion was evaluated. The evaluation criteria are as follows, and ⊙ and ○ were judged to be acceptable.

⊙: Contamination by white toner is not recognized visually or by optical microscope, ○: Contamination is not visually recognized but is slightly recognized when observed by optical microscope, and X: Contamination is visually clearly recognized.

TABLE 2

| | Configuration of toner | | | | | | |
|---|---|---|---|---|---|---|---|
| | White toner particles | Toner base particles | White pigment dispersion | Binder resin | Crystalline polyester resin (CPES) | Average particle size of $TiO_2$ [nm] | Amount of $TiO_2$ added [parts by mass] |
| Example | 1 | Base 1 | W2 | PES | Presence | 150 | 25 |
| Example | 2 | Base 2 | W3 | PES | Presence | 300 | 25 |
| Example | 3 | Base 3 | W4 | PES | Presence | 500 | 25 |
| Example | 4 | Base 2 | W3 | PES | Presence | 300 | 25 |
| Example | 5 | Base 2 | W3 | PES | Presence | 300 | 25 |
| Example | 6 | Base 4 | W6 | PES | Presence | 300 | 25 |
| Example | 7 | Base 2 | W3 | PES | Presence | 300 | 25 |
| Example | 8 | Base 2 | W3 | PES | Presence | 300 | 25 |
| Example | 9 | Base 5 | W3 | PES + StAC | Presence | 300 | 25 |
| Example | 10 | Base 6 | W3 | StAC | Presence | 300 | 25 |
| Example | 11 | Base 7 | W3 | PES | Absence | 300 | 25 |
| Example | 12 | Base 8 | W3 | StAC | Absence | 300 | 25 |
| Example | 13 | Base 9 | W3 | PES | Presence | 300 | 18 |
| Example | 14 | Base 10 | W3 | PES | Presence | 300 | 42 |
| Example | 15 | Base 2 | W3 | PES | Presence | 300 | 25 |
| Example | 16 | Base 2 | W3 | PES | Presence | 300 | 25 |
| Example | 17 | Base 2 | W3 | PES | Presence | 300 | 25 |
| Comparative Example | 18 | Base 2 | W3 | PES | Presence | 300 | 25 |
| Comparative Example | 19 | Base 11 | W1 | PES | Presence | 100 | 25 |
| Comparative Example | 20 | Base 12 | W5 | PES | Presence | 700 | 25 |
| Comparative Example | 21 | Base 5 | W3 | PES + StAC | Presence | 300 | 25 |
| Comparative Example | 22 | Base 6 | W3 | StAC | Presence | 300 | 25 |

TABLE 2-continued

| | | | | | | | |
|---|---|---|---|---|---|---|---|
| Comparative Example | 23 | Base 7 | W3 | PES | Absence | 300 | 25 |
| Comparative Example | 24 | Base 8 | W3 | StAC | Absence | 300 | 25 |
| Comparative Example | 25 | Base 9 | W3 | PES | Presence | 300 | 18 |

| | | Configuration of toner | | | | Evaluation | | | | |
|---|---|---|---|---|---|---|---|---|---|---|
| | White toner particles | Surface treatment | Average particle size of $SrTiO_3$ [nm] | Amount of $SrTiO_3$ added [parts by mass] | Adhesive strength [%] | Degree of initial whiteness | L* | Yellowing | ΔE | Image at HH |
| Example | 1 | Presence | 800 | 1 | 70 | ⊙ | 94.1 | ⊙ | 1.4 | ⊙ |
| Example | 2 | Presence | 800 | 1 | 70 | ⊙ | 93.3 | ⊙ | 1.0 | ⊙ |
| Example | 3 | Presence | 800 | 1 | 70 | ⊙ | 93.0 | ⊙ | 0.8 | ⊙ |
| Example | 4 | Presence | 480 | 1 | 80 | ⊙ | 93.5 | ⊙ | 0.8 | ○ |
| Example | 5 | Presence | 2100 | 1 | 60 | ⊙ | 93.2 | ○ | 2.0 | ⊙ |
| Example | 6 | Absence | 800 | 1 | 70 | ⊙ | 93.0 | ○ | 4.0 | ○ |
| Example | 7 | Presence | 800 | 0.09 | 80 | ⊙ | 93.0 | ○ | 5.0 | ○ |
| Example | 8 | Presence | 800 | 11 | 70 | ⊙ | 94.0 | ⊙ | 0.6 | ○ |
| Example | 9 | Presence | 800 | 1 | 70 | ⊙ | 93.5 | ⊙ | 0.9 | ⊙ |
| Example | 10 | Presence | 800 | 1 | 70 | ⊙ | 93.5 | ⊙ | 0.8 | ⊙ |
| Example | 11 | Presence | 800 | 1 | 70 | ○ | 90.0 | ⊙ | 1.0 | ⊙ |
| Example | 12 | Presence | 800 | 1 | 70 | ○ | 90.0 | ⊙ | 0.7 | ⊙ |
| Example | 13 | Presence | 800 | 1 | 70 | ○ | 85.0 | ⊙ | 0.9 | ⊙ |
| Example | 14 | Presence | 800 | 1 | 70 | ⊙ | 95.0 | ○ | 1.8 | ○ |
| Example | 15 | Presence | 800 | 1 | 30 | ⊙ | 93.0 | ○ | 3.0 | ⊙ |
| Example | 16 | Presence | 1700 | 1 | 65 | ⊙ | 93.5 | ⊙ | 1.4 | ⊙ |
| Example | 17 | Presence | 800 | 7 | 80 | ⊙ | 93.7 | ⊙ | 0.7 | ⊙ |
| Comparative Example | 18 | Presence | — | Absence | — | ⊙ | 93.0 | X | 8.0 | X |
| Comparative Example | 19 | Presence | 800 | 1 | 70 | ⊙ | 94.3 | X | 6.1 | ○ |
| Comparative Example | 20 | Presence | 800 | 1 | 70 | X | 84.0 | ⊙ | 1.0 | ⊙ |
| Comparative Example | 21 | Presence | — | Absence | — | ⊙ | 93.0 | X | 7.0 | X |
| Comparative Example | 22 | Presence | — | Absence | — | ⊙ | 93.0 | X | 6.5 | X |
| Comparative Example | 23 | Presence | — | Absence | — | ○ | 89.5 | X | 8.0 | X |
| Comparative Example | 24 | Presence | — | Absence | — | ○ | 89.5 | X | 6.1 | X |
| Comparative Example | 25 | Presence | $CeO_2$/800 | 1 | 70 | X | 82.0 | ⊙ | 1.4 | ⊙ |

REFERENCE SIGNS LIST

3 Conductive sleeve,
32 Magnet roll,
33 Bias supply,
34 Cylindrical electrode.

Although embodiments of the present invention have been described and illustrated in detail, it is clearly understood that the same is by way of illustration and example only and not limitation, the scope of the present invention should be interpreted by terms of the appended claims.

What is claimed is:

1. A toner for developing an electrostatic image, the toner comprising:

white toner base particles containing a binder resin and titanium oxide having an average particle size of from 130 to 600 nm; and an external additive including strontium titanate so as to decrease ultraviolet rays reaching the titanium oxide present inside the white toner base particles.

2. The toner according to claim 1, wherein an average particle size of the strontium titanate is from 500 to 2,000 nm.

3. The toner according to claim 1, wherein the titanium oxide has a surface treatment layer of an inorganic compound.

4. The toner according to claim 3, wherein the inorganic compound includes at least one kind selected from the group consisting of Si, Al, Zr, and Zn.

5. The toner according to claim 1, wherein the strontium titanate is contained at from 0.1 to 10 parts by mass with respect to 100 parts by mass of the white toner base particles.

6. The toner according to claim 1, wherein the binder resin includes a polyester resin.

7. The toner according to claim 6, wherein the polyester resin includes an amorphous polyester resin.

8. The toner according to claim 1, wherein the binder resin includes a vinyl resin.

9. The toner according to claim 7, wherein the binder resin includes a crystalline polyester resin.

10. The toner according to claim 1, wherein the titanium oxide is contained at from 20 to 40 parts by mass with respect to 100 parts by mass of the white toner base particles excluding titanium oxide.

11. The toner according to claim 1, wherein an adhesive strength of the strontium titanate is more than 30%.

12. The toner according to claim 1, wherein the toner further contains other external additives including silica, and the toner is prepared by adding the strontium titanate to the white toner base particles, and then adding the other external additives thereto.

* * * * *